US009077085B2

(12) United States Patent
Wong et al.

(10) Patent No.: US 9,077,085 B2
(45) Date of Patent: Jul. 7, 2015

(54) COMMUNICATION DEVICE AND ANTENNA SYSTEM WITH HIGH ISOLATION

(71) Applicant: Acer Incorporated, Hsichih, Taipei Hsien (TW)

(72) Inventors: Kin-Lu Wong, Taipei Hsien (TW); Wun-Jian Lin, Taipei Hsien (TW)

(73) Assignee: ACER INCORPORATED, Hsichih, Taipei Hsien (TW)

( * ) Notice: Subject to any disclaimer, the term of this patent is extended or adjusted under 35 U.S.C. 154(b) by 271 days.

(21) Appl. No.: 13/777,587

(22) Filed: Feb. 26, 2013

(65) Prior Publication Data

US 2014/0078018 A1 Mar. 20, 2014

(30) Foreign Application Priority Data

Sep. 14, 2012 (TW) ..... 101133609 A

(51) Int. Cl.
*H01Q 1/24* (2006.01)
*H01Q 21/28* (2006.01)
*H01Q 1/52* (2006.01)

(52) U.S. Cl.
CPC ..... *H01Q 21/28* (2013.01); *H01Q 1/243* (2013.01); *H01Q 1/523* (2013.01)

(58) Field of Classification Search
CPC ..... H01Q 1/243; H01Q 1/523
USPC ..... 343/700 MS, 702, 725
See application file for complete search history.

(56) References Cited

U.S. PATENT DOCUMENTS 4,382,260 A * 5/1983 Ranghelli ..... 343/730
5,990,838 A * 11/1999 Burns et al. ..... 343/702
7,724,201 B2 * 5/2010 Nysen et al. ..... 343/821
7,911,387 B2 * 3/2011 Hill et al. ..... 343/700 MS

FOREIGN PATENT DOCUMENTS

EP 2 466 684 6/2012

OTHER PUBLICATIONS

European Search Report dated Jan. 3, 2014.
Diallo, A., et al.; "Enhanced Two-Antenna Structures for Universal Mobile Telecommunications System Diversity Terminals;" Feb. 4, 2008; pp. 93-101.
Luxey, C.; "Design of Multi-Antenna Systems for UMTS Mobile Phones;" Loughborough Antennas and Propagation Conference; Nov. 2009; pp. 57-64.

(Continued)

*Primary Examiner* — Tho G Phan
(74) *Attorney, Agent, or Firm* — McClure, Qualey & Rodack, LLP

(57) ABSTRACT

A communication device including a ground element and an antenna system is provided. The antenna system is adjacent to the ground element. The antenna system includes at least a first antenna, a second antenna, a connection element, and a resistive element. The second antenna is adjacent to the first antenna. The connection element includes a first portion and a second portion, wherein the first portion is coupled to the first antenna, and the second portion is coupled to the second antenna. The resistive element is coupled between the first portion and the second portion of the connection element. The connection element and the resistive element increase the isolation between the first antenna and the second antenna.

7 Claims, 5 Drawing Sheets

(56) References Cited

OTHER PUBLICATIONS

Minutes of the SWG 1.1 Meeting Antenna System Aspects; Oct. 2011; pp. 1-4.

Su, S.W., et al.; "Printed Two Monopole-Antenna System with a Decoupling Neutralization Line for 2.4-GHz MIMO Applications;" Microwave and Optical Technology Letters; vol. 53; No. 9; Sep. 2011; pp. 2037-2043.

* cited by examiner

COMMUNICATION DEVICE AND ANTENNA SYSTEM WITH HIGH ISOLATION

CROSS REFERENCE TO RELATED APPLICATIONS

This Application claims priority of Taiwan Patent Application No. 101133609 filed on Sep. 14, 2012, the entirety of which is incorporated by reference herein.

BACKGROUND OF THE INVENTION

1. Field of the Invention

The disclosure generally relates to a communication device, and more particularly, relates to a communication device comprising an antenna system with high isolation.

2. Description of the Related Art

In recent years, the smart phone has become one of the most indispensable mobile communication devices for modern people to use in their daily lives, allowing for convenience and timeliness. A user usually demands a variety of functions for smart phones. For example, the smart phone is required to perform MIMO (Multi-Input Multi-Output) operations by multiple antennas therein to accelerate data transmission, or is required to have functions of dual-SIM, dual-standby, and dual-talk. Thus, while a first SIM (Subscriber Identity Module) card of the smart phone is transmitting data through an antenna, a second SIM card of the smart phone is capable of transmitting voice signals through another antenna; bringing convenience to a user with a dual-SIM smart phone. As for antenna systems in mobile communication devices, an antenna system with multiple antennas operating in a same band must be disposed in a small space of a mobile communication device (e.g., a smart phone). Since the antennas are very close to each other, mutual coupling and interference therebetween are enhanced, thereby degrading the performance of the antenna system. Thus, maintaining a high amount of isolation and reducing mutual coupling and interference between antennas are critical challenges for antenna designers.

Accordingly, there is a need to design a new antenna system with multiple antennas, which may be applied to a mobile communication device. Such an antenna system would not only have high isolation between antennas therein but also maintain good radiation efficiency to meet practical application requirements.

BRIEF SUMMARY OF THE INVENTION

The invention is aimed to provide a communication device comprising an antenna system. To improve the isolation between multiple antennas of the antenna system, the invention provides a resistive element, which is coupled between these antennas and attracts coupling currents on a feeding end of each antenna. Accordingly, the invention effectively improves the isolation between the antennas without negatively affecting the antenna efficiency.

In a preferred embodiment, the disclosure is directed to a communication device, comprising: a ground element; and an antenna system, adjacent to the ground element, wherein the antenna system at least comprises: a first antenna; a second antenna, adjacent to the first antenna; a connection element, comprising a first portion and a second portion, wherein the first portion is coupled to the first antenna, and the second portion is coupled to the second antenna; and a resistive element, coupled between the first portion and the second portion of the connection element, wherein the connection element and the resistive element increase isolation between the first antenna and the second antenna.

In a preferred embodiment, the disclosure is directed to a communication device, comprising: a ground element; and an antenna system, adjacent to the ground element, wherein the antenna system at least comprises: a first antenna, comprising a first feeding element; a second antenna, adjacent to the first antenna, and comprising a second feeding element; and a resistive element, coupled between the first feeding element and the second feeding element, wherein the resistive element increases isolation between the first antenna and the second antenna.

In an embodiment, the antenna system comprising at least the first antenna and the second antenna uses the connection element and the resistive element to increase the isolation between the first antenna and the second antenna. The poor isolation results from coupling currents being present between the antennas. When the first antenna is excited, the second antenna captures a portion of energy in the first antenna, thereby reducing the isolation between the antennas. In a preferred embodiment, the resistive element is disposed between the first antenna and the second antenna to absorb the coupling currents therebetween such that the isolation between the first antenna and the second antenna is enhanced. Accordingly, both the first antenna and the second antenna maintain good radiation efficiency.

In an embodiment, the resistive element is used to increase the isolation between the first antenna and the second antenna, wherein the resistive element is a chip resistor. In other words, the invention merely uses a simple chip resistor to effectively improve the resulting isolation of the antenna system. In a preferred embodiment, the resistance of the chip resistor is at least 75Ω.

In an embodiment, the first antenna and the second antenna operate in at least one same mobile communication band. With the operation band of the first antenna overlapping with that of the second antenna, the isolation between the first antenna and the second antenna becomes meaningful.

In an embodiment, the first antenna further comprises a first feeding element, and the second antenna further comprises a second feeding element. The connection element is coupled between the first feeding element and the second feeding element. Accordingly, the resistive element can absorb the coupling currents between the first antenna and the second antenna via the connection element, and effectively improve the resulting isolation between the first antenna and the second antenna.

In an embodiment, the first antenna further comprises a first shorted element, and the second antenna further comprises a second shorted element. The connection element is coupled between the first shorted element and the second shorted element. Accordingly, the resistive element can absorb the coupling currents between the first antenna and the second antenna via the connection element, and effectively improve the isolation between the first antenna and the second antenna.

In another embodiment, the first antenna further comprises a first feeding element and a first shorted element, and the second antenna further comprises a second feeding element and a second shorted element. The connection element is coupled between the first feeding element and the second shorted element, or the connection element is coupled between the second feeding element and the first shorted element. Accordingly, the resistive element can absorb the coupling currents between the first antenna and the second antenna via the connection element, and effectively improve the resulting isolation between the first antenna and the second antenna.

In an embodiment, the antenna system is adjacent to a corner of the ground element, and the first antenna and the second antenna are adjacent to two edges of the ground element, respectively, wherein the edges of the ground element are substantially perpendicular to each other. Accordingly, the resistive element can absorb the coupling currents between the first antenna and the second antenna via the connection element, and effectively improve the isolation between the first antenna and the second antenna.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1:
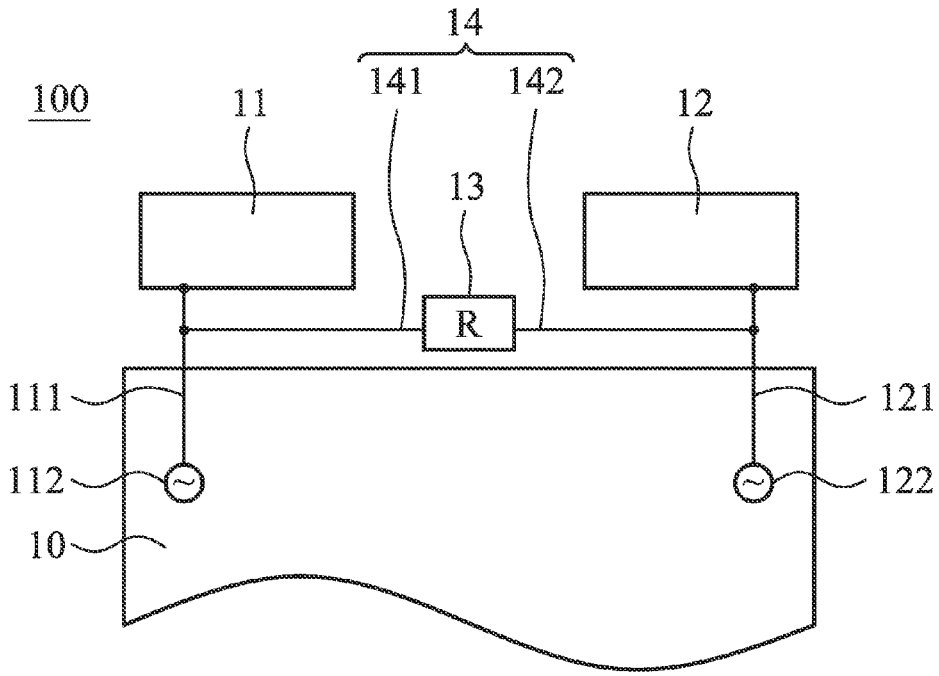
FIG. 1 is a diagram for illustrating a communication device according to a first embodiment of the invention.

FIG. 1 is a diagram for illustrating a communication device 100 according to a first embodiment of the invention. The communication device 100 may be a smart phone, a tablet computer, or a notebook computer. As shown in FIG. 1, the communication device 100 comprises a ground element 10 and an antenna system. The antenna system is adjacent to the ground element 10. The antenna system at least comprises a first antenna 11, a second antenna 12, a resistive element 13, and a connection element 14. The second antenna 12 is adjacent to the first antenna 11. The connection element 14 comprises a first portion 141 and a second portion 142, wherein the first portion 141 is coupled to the first antenna 11, and the second portion 142 is coupled to the second antenna 12. The resistive element 13 is coupled between the first portion 141 and the second portion 142 of the connection element 14. In another embodiment, the first antenna 11 further comprises a first feeding element 111 coupled to a first signal source 112, and the second antenna 12 further comprises a second feeding element 121 coupled to a second signal source 122. Note that the invention is not limited to the above. In other embodiments, the communication device 100 further comprises other essential components, such as a dielectric substrate, a processor, a battery, and a housing (not shown).

Figure 2A:
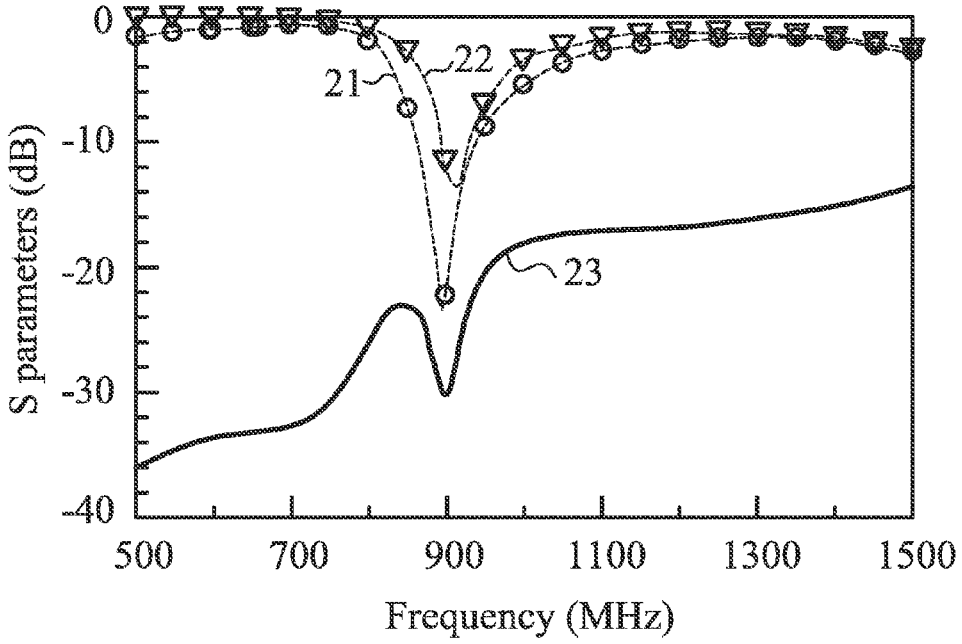
FIG. 2A is a diagram for illustrating S parameters of an antenna system of a communication device according to a first embodiment of the invention.

FIG. 2A is a diagram for illustrating S parameters of the antenna system of the communication device 100 according to the first embodiment of the invention. In some embodiments, the ground element 10 has a length of about 120 mm and has a width of about 70 mm. Each of the first antenna 11 and the second antenna 12 has a total size of about 1500 $mm^3$ (30 mm by 10 mm by 5 mm). The first antenna 11 and the second antenna 12 both generate resonant modes at a low frequency of about 900 MHz to cover a GSM900 band (from about 880 MHz to 960 MHz). The reflection coefficient (S11) curve 21 represents the reflection coefficient (S11) of the first antenna 11. The reflection coefficient (S22) curve 22 represents the reflection coefficient (S22) of the second antenna 12. The isolation (S21) curve 23 represents the isolation (S21) between the first antenna 11 and the second antenna 12. As shown in FIG. 2A, the first antenna 11 and the second antenna 12 may operate in at least one same mobile communication band. In some embodiments, the resistance of the resistive element 13 is about 300Ω. The resistive element 13 and the connection element 14 can improve the isolation (S21) between the first antenna 11 and the second antenna 12 to the lowest value of about −30 dB in the GSM900 band.

Figure 2B:
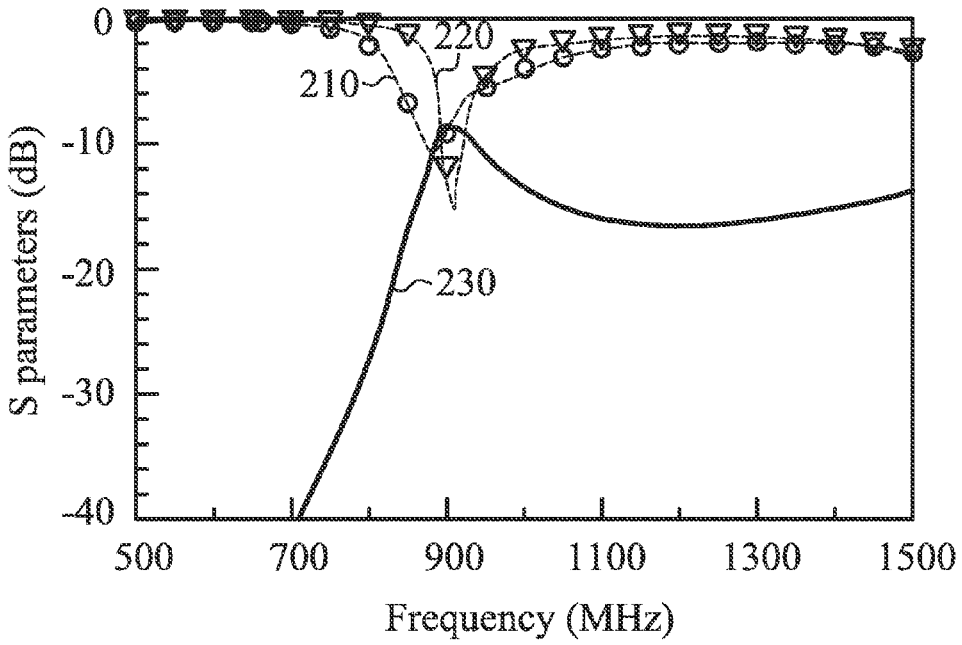
FIG. 2B is a diagram for illustrating S parameters of an antenna system of a communication device without any resistive element according to a first embodiment of the invention.

FIG. 2B is a diagram for illustrating S parameters of the antenna system of the communication device 100 without the resistive element 13 according to the first embodiment of the invention. In the example, the resistive element 13 has been removed from the antenna system. The reflection coefficient (S11) curve 210 represents the reflection coefficient (S11) of the first antenna 11. The reflection coefficient (S22) curve 220 represents the reflection coefficient (S22) of the second antenna 12. The isolation (S21) curve 230 represents the isolation (S21) between the first antenna 11 and the second antenna 12. In comparison to FIG. 2A, when the resistive element 13 of the antenna system is removed, the isolation (S21) between the first antenna 11 and the second antenna 12 is from about −9 dB to −11 dB in the GSM900 band. According to FIGS. 2A and 2B, it is understood that if the resistive element 13 is incorporated into the antenna system, the resistive element 13 can effectively absorb the coupling currents between the first antenna 11 and the second antenna 12, thereby improving the isolation between the first antenna 11 and the second antenna 12 very much.

Figure 3:
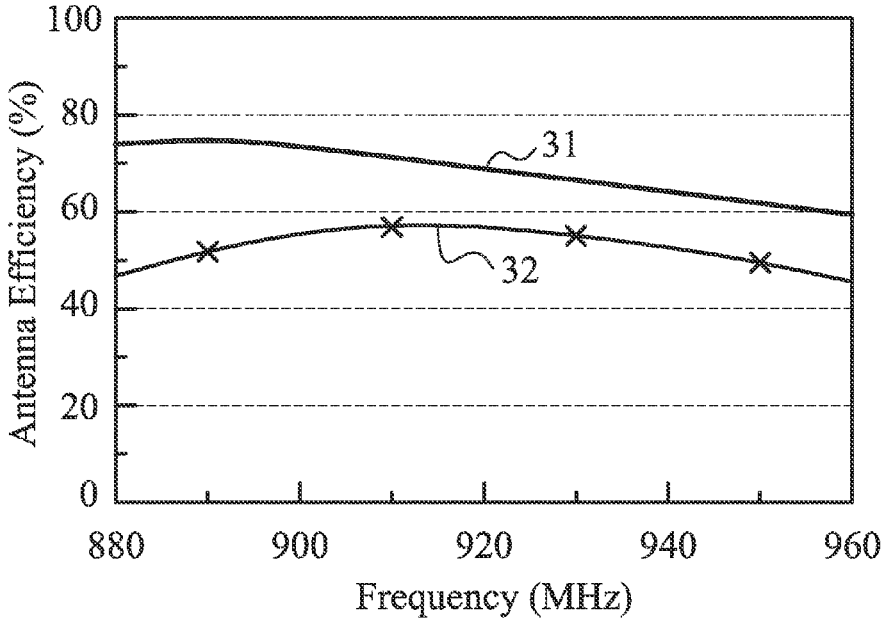
FIG. 3 is a diagram for illustrating antenna efficiency of an antenna system of a communication device according to a first embodiment of the invention.

FIG. 3 is a diagram for illustrating antenna efficiency of the antenna system of the communication device 100 according to the first embodiment of the invention. The antenna efficiency curve 31 represents the antenna efficiency of the first antenna 11, and the antenna efficiency curve 32 represents the antenna efficiency of the second antenna 12. As shown in FIG. 3, the first antenna 11 and the second antenna 12 both have high antenna efficiency (including the return loss) in the GSM900 band. The invention is suitably applied to a mobile communication device, which comprises multiple antennas therein to provide a variety of functions. The invention not only improves the isolation between the antennas but also maintains high antenna efficiency to meet practical application requirements.

Figure 4:
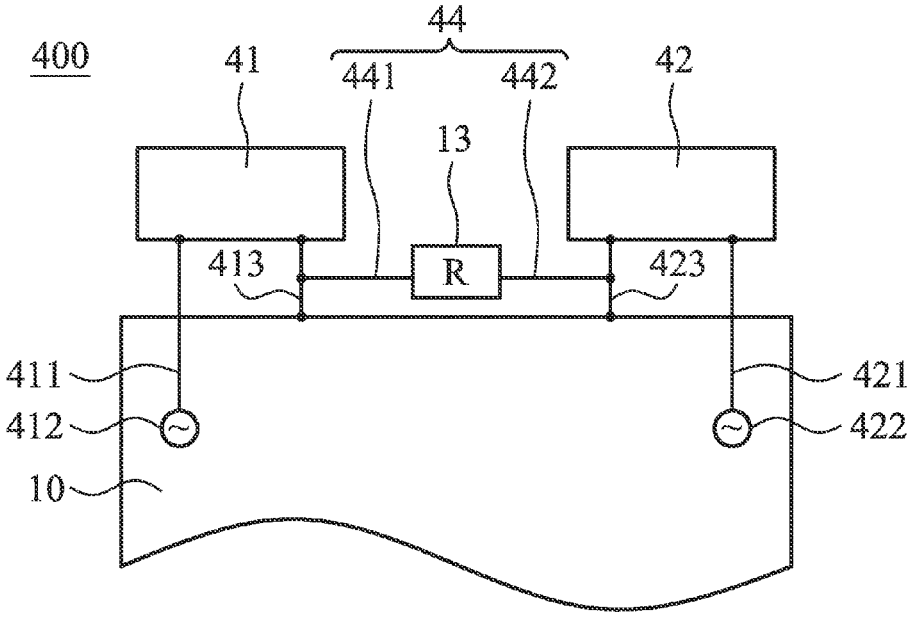
FIG. 4 is a diagram for illustrating a communication device according to a second embodiment of the invention.

FIG. 4 is a diagram for illustrating a communication device 400 according to a second embodiment of the invention. An antenna system of the communication device 400 comprises a first antenna 41 and a second antenna 42. In the second embodiment, the first antenna 41 further comprises a first shorted element 413, and the second antenna 42 further comprises a second shorted element 423, wherein the first shorted element 413 and the second shorted element 423 are coupled to the ground element 10, respectively. A connection element 44 comprises a first portion 441 and a second portion 442, wherein the first portion 441 is coupled to the first shorted element 413, and the second portion 442 is coupled to the second shorted element 423. Other features of the communication device 400 in the second embodiment are similar to those in the first embodiment. In the second embodiment, the resistive element 13 is coupled between the first shorted element 413 of the first antenna 41 and the second shorted element 423 of the second antenna 42 so as to absorb the coupling currents between the first antenna 41 and the second antenna 42. Accordingly, the performance of the communication device 400 in the second embodiment is similar to that in the first embodiment.

Figure 5:
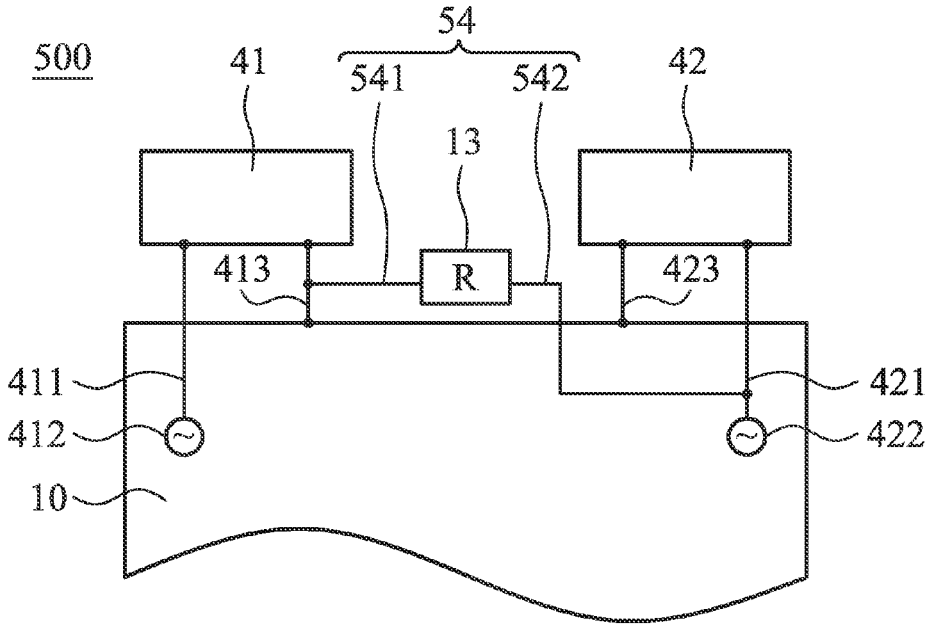
FIG. 5 is a diagram for illustrating a communication device according to a third embodiment of the invention.

FIG. 5 is a diagram for illustrating a communication device 500 according to a third embodiment of the invention. In the third embodiment, the first antenna 41 further comprises a first feeding element 411 and a first shorted element 413, and the second antenna 42 further comprises a second feeding element 421 and a second shorted element 423. A connection element 54 comprises a first portion 541 and a second portion 542, wherein the first portion 541 is coupled to the first shorted element 413 of the first antenna 41, and the second portion 542 is coupled to the second feeding element 421 of the second antenna 42. Other features of the communication device 500 in the third embodiment are similar to those in the second embodiment. The resistive element 13 may have different connection positions but still absorb the coupling currents between the first antenna 41 and the second antenna 42. Accordingly, the performance of the communication device 500 in the third embodiment is similar to that in the first embodiment.

Figure 6:
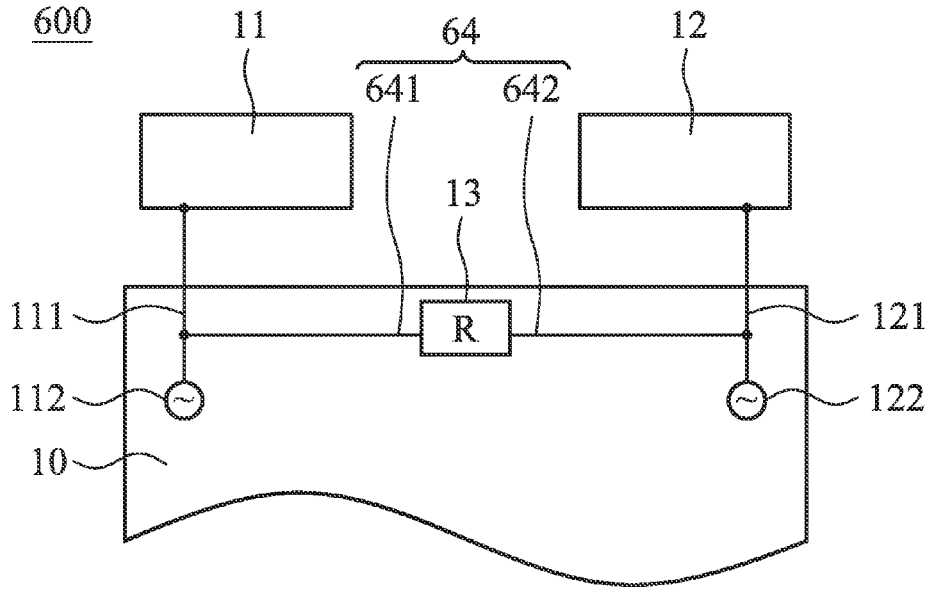
FIG. 6 is a diagram for illustrating a communication device according to a fourth embodiment of the invention.

FIG. 6 is a diagram for illustrating a communication device 600 according to a fourth embodiment of the invention. In the fourth embodiment, a connection element 64 comprises a first portion 641 and a second portion 642, wherein a vertical projection of the first portion 641 overlaps with the ground element 10, and a vertical projection of the second portion 642 also overlaps with the ground element 10. The first portion 641 of the connection element 64 is coupled to the first feeding element 111 of the first antenna 11, and the second portion 642 of the connection element 64 is coupled to the second feeding element 121 of the second antenna 12. In the fourth embodiment, the connection element 64 and the resistive element 13 are disposed above the ground element 10. Other features of the communication device 600 in the fourth embodiment are similar to those in the first embodiment. The resistive element 13 can absorb the coupling currents between the first antenna 11 and the second antenna 12. Accordingly, the performance of the communication device 600 in the fourth embodiment is similar to that in the first embodiment.

Figure 7:
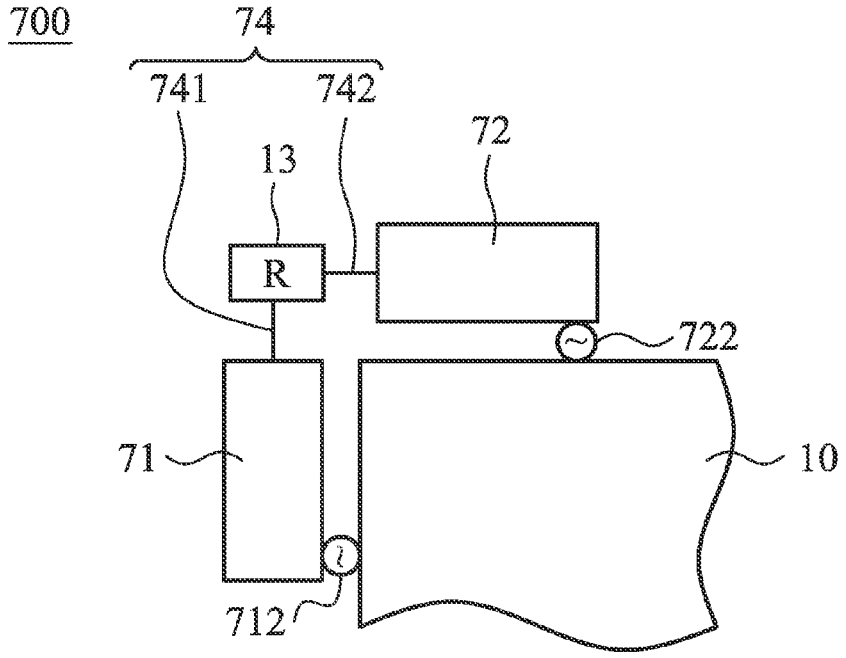
FIG. 7 is a diagram for illustrating a communication device according to a fifth embodiment of the invention.

FIG. 7 is a diagram for illustrating a communication device 700 according to a fifth embodiment of the invention. In the fifth embodiment, an antenna system of the communication device 700 is adjacent to a corner of the ground element 10. The antenna system comprises a first antenna 71 and a second antenna 72. The first antenna 71 and the second antenna 72 are adjacent to two edges of the ground element 10, respectively, wherein the two edges of the ground element 10 are substantially perpendicular to each other. A connection element 74 comprises a first portion 741 and a second portion 742, wherein the first portion 741 is coupled to the first antenna 71, and the second portion 742 is coupled to the second antenna 72. In the fifth embodiment, the connection element 74 and the resistive element 13 may be both coupled between the first antenna 71 and the second antenna 72. In other words, the connection positions of the connection element 74 and the resistive element 13 are not limitations of the invention. Other features of the communication device 700 in the fifth embodiment are similar to those in the first embodiment. The resistive element 13 can absorb the coupling currents between the first antenna 71 and the second antenna 72. Accordingly, the performance of the communication device 700 in the fifth embodiment is similar to that in the first embodiment.

Figure 8:
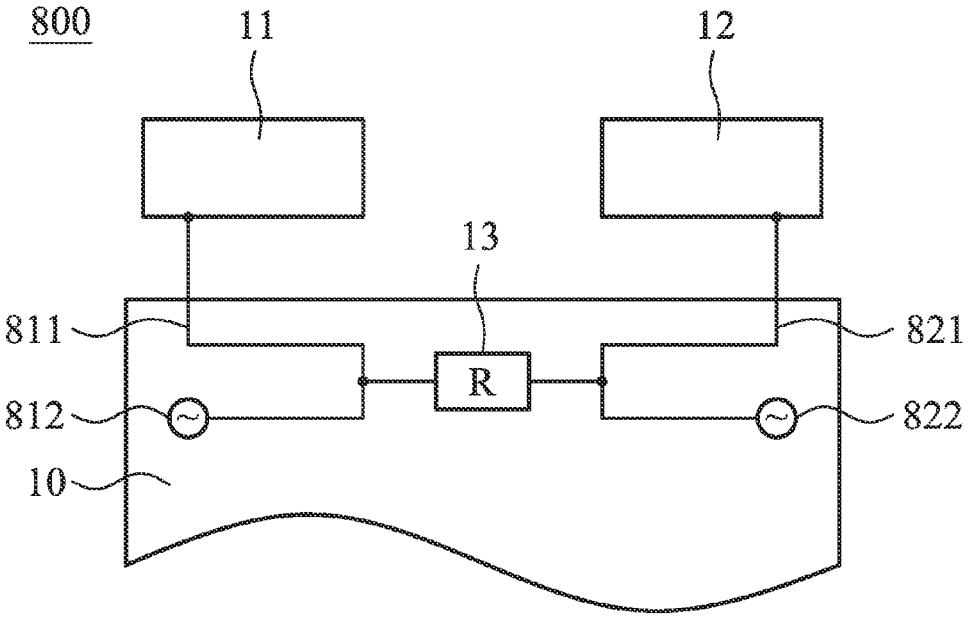
FIG. 8 is a diagram for illustrating a communication device according to a sixth embodiment of the invention.

FIG. 8 is a diagram for illustrating a communication device 800 according to a sixth embodiment of the invention. In the sixth embodiment, the first antenna 11 further comprises a first feeding element 811 for transmitting a microwave signal of a first signal source 812 to the first antenna 11, and the second antenna 12 further comprises a second feeding element 821 for transmitting a microwave signal of a second signal source 822 to the second antenna 12. The first feeding element 811 and the second feeding element 821 may have a variety of shapes, such as S shapes and L shapes. In the sixth embodiment, the resistive element 13 is directly coupled between the first feeding element 811 of the first antenna 11 and the second feeding element 821 of the second antenna 12. Note that the resistive element 13 is not coupled through any connection element. Other features of the communication device 800 in the sixth embodiment are similar to those in the first embodiment. The resistive element 13 can absorb the coupling currents between the first antenna 11 and the second antenna 12. Accordingly, the performance of the communication device 800 in the sixth embodiment is similar to that in the first embodiment.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna system, adjacent to the ground element, wherein the antenna system at least comprises:

a first antenna;

a second antenna, adjacent to the first antenna;

a connection element, comprising a first portion and a second portion, wherein the first portion is coupled to the first antenna, and the second portion is coupled to the second antenna; and a resistive element, coupled between the first portion and the second portion of the connection element, wherein the connection element and the resistive element increase isolation between the first antenna and the second antenna;

wherein the first antenna further comprises a first feeding element coupled to a first signal source, and a first shorted element coupled to the ground element, wherein the second antenna further comprises a second feeding element coupled to a second signal source, and a second shorted element coupled to the ground element, and wherein the connection element is coupled between the first feeding element and the second shorted element.

2. The communication device as claimed in claim 1, wherein the resistive element is a chip resistor, and a resistance of the chip resistor is at least 75Ω.

3. The communication device as claimed in claim 1, wherein the first antenna and the second antenna operate in at least one same mobile communication band.

4. The communication device as claimed in claim 1, wherein the first feeding element has an S shape or an L shape.

5. The communication device as claimed in claim 1, wherein the second feeding element has an S shape or an L shape.

6. The communication device as claimed in claim 1, wherein the connection element is disposed above the ground element, such that a vertical projection of the first portion overlaps with the ground element and a vertical projection of the second portion overlaps with the ground element.

7. The communication device as claimed in claim 1, wherein the antenna system is adjacent to a corner of the ground element, the first antenna and the second antenna are adjacent to two edges of the ground element, respectively, and the edges of the ground element are substantially perpendicular to each other.

* * * * *